US007963392B2

(12) United States Patent
Kodi

(10) Patent No.: US 7,963,392 B2
(45) Date of Patent: Jun. 21, 2011

(54) BAR CONNECTING APPARATUS

(75) Inventor: Jon R. Kodi, Lebanon, TN (US)

(73) Assignee: Kodi Klip Corporation, Lebanon, TN (US)

( * ) Notice: Subject to any disclaimer, the term of this patent is extended or adjusted under 35 U.S.C. 154(b) by 1008 days.

(21) Appl. No.: 11/778,174

(22) Filed: Jul. 16, 2007

(65) Prior Publication Data

US 2008/0115449 A1 May 22, 2008

Related U.S. Application Data

(63) Continuation-in-part of application No. 11/622,674, filed on Jan. 12, 2007.

(60) Provisional application No. 60/860,434, filed on Nov. 21, 2006, provisional application No. 60/911,401, filed on Apr. 12, 2007.

(51) Int. Cl.

| | |
|---|---|
| ***B65D 85/24*** | (2006.01) |
| ***F16G 11/06*** | (2006.01) |
| ***F16B 21/08*** | (2006.01) |
| ***F16B 7/04*** | (2006.01) |
| ***E04C 5/16*** | (2006.01) |
| ***A41F 1/00*** | (2006.01) |

(52) U.S. Cl. ..... 206/340; 403/396; 403/397; 403/400; 52/719; 24/545; 29/525.01

(58) Field of Classification Search ..... 403/396, 403/397, 400; 29/252.01, 525.01; 52/687, 52/719; 24/545; 206/340

See application file for complete search history.

(56) References Cited

U.S. PATENT DOCUMENTS

| | | | | | |
|---|---|---|---|---|---|
| 721,434 | A | | 2/1903 | Edeburn | |
| 871,210 | A | * | 11/1907 | Cummings | 52/686 |
| 1,058,908 | A | * | 4/1913 | Schoenthaler | 52/687 |
| 1,060,919 | A | * | 5/1913 | Luten | 52/684 |
| 1,387,088 | A | * | 8/1921 | White | 52/688 |
| 1,451,717 | A | | 4/1923 | Sommer | |
| 1,852,673 | A | | 4/1932 | Pilj | |
| 1,986,528 | A | * | 1/1935 | Ranger | 52/719 |
| 1,996,047 | A | * | 3/1935 | Green | 52/667 |
| 2,551,826 | A | | 5/1951 | Cox, Sr. | 72/122 |
| 2,571,337 | A | | 10/1951 | Burnham | 61/48 |

(Continued)

FOREIGN PATENT DOCUMENTS

JP 04108944 8/1992

(Continued)

OTHER PUBLICATIONS

U.S. Appl. No. 11/333,756, filed Jan. 17, 2006 by Jon Kodi. (not prior art).

(Continued)

*Primary Examiner* — David P Bryant
*Assistant Examiner* — Jacob J Cigna
(74) *Attorney, Agent, or Firm* — Waddey & Patterson, P.C.; Lucian Wayne Beavers

(57) ABSTRACT

A bar connecting apparatus applies clips to connect transverse bars used in reinforced concrete. A clip string is fed into the bar connecting apparatus by a clip feed assembly, so several pairs of transverse bars can be connected in rapid succession. A hammer reciprocates in the barrel of the bar connecting apparatus, and drives a clip from the barrel into engagement with the bars. An alignment head aligns the bar connecting apparatus with the transverse bars so the clips properly engage the bars.

12 Claims, 12 Drawing Sheets

U.S. PATENT DOCUMENTS

| | | | | | |
|---|---|---|---|---|---|
| 2,879,087 | A | | 3/1959 | Haglund | 287/54 |
| 3,004,370 | A | * | 10/1961 | Tinnerman | 52/719 |
| 3,006,115 | A | | 10/1961 | Hillberg | 50/322 |
| 3,164,250 | A | * | 1/1965 | Paxton | 206/343 |
| 3,191,723 | A | * | 6/1965 | Shoup | 52/246 |
| 3,216,752 | A | | 11/1965 | Rifken | 287/54 |
| 3,360,883 | A | | 1/1968 | Glanzer | 46/29 |
| 3,461,536 | A | | 8/1969 | Skold | |
| 3,471,987 | A | * | 10/1969 | Yelsma | 52/684 |
| 3,521,332 | A | * | 7/1970 | Kramer | 403/188 |
| 3,694,988 | A | | 10/1972 | Skold | |
| 3,788,025 | A | | 1/1974 | Holmes | 52/685 |
| 3,903,574 | A | * | 9/1975 | Fraioli | 403/398 |
| 4,060,954 | A | | 12/1977 | Liuzza | 52/677 |
| 4,080,770 | A | | 3/1978 | Vigh | 52/689 |
| 4,102,586 | A | * | 7/1978 | Pearson et al. | 403/188 |
| 4,110,951 | A | | 9/1978 | Padrun | |
| 4,136,984 | A | | 1/1979 | Hayashi | 403/170 |
| 4,136,985 | A | | 1/1979 | Taul | 403/172 |
| 4,214,841 | A | | 7/1980 | Hayashi | 403/188 |
| D264,682 | S | * | 6/1982 | Van Doren | D8/354 |
| 4,334,613 | A | * | 6/1982 | Males et al. | 206/340 |
| 4,388,791 | A | | 6/1983 | Anderson | |
| 4,440,519 | A | | 4/1984 | Pennel et al. | 403/391 |
| 4,482,088 | A | | 11/1984 | Hyun | 227/67 |
| 4,511,073 | A | | 4/1985 | Furutsu | 227/67 |
| 4,610,122 | A | | 9/1986 | De Clercq | 52/719 |
| 4,617,775 | A | * | 10/1986 | Padrun | 52/684 |
| D295,724 | S | * | 5/1988 | Shioda | D8/396 |
| 4,800,702 | A | | 1/1989 | Wheeler | 52/677 |
| 4,807,345 | A | | 2/1989 | Jacobson | |
| 4,835,933 | A | | 6/1989 | Yung | 52/685 |
| 4,991,372 | A | | 2/1991 | Sonneville | 52/685 |
| 5,269,054 | A | | 12/1993 | Poteat et al. | |
| 5,370,293 | A | | 12/1994 | Bevins | 227/63 |
| 5,371,991 | A | * | 12/1994 | Bechtel et al. | 52/686 |
| D355,582 | S | | 2/1995 | Sleight | D8/354 |
| 5,518,399 | A | | 5/1996 | Sicurelli, Jr. et al. | 433/220 |
| 5,588,554 | A | | 12/1996 | Jones | 221/88 |
| 5,595,039 | A | | 1/1997 | Lowery | 52/677 |
| 5,626,436 | A | * | 5/1997 | Dragone | 403/400 |
| 5,683,025 | A | | 11/1997 | Grendol | 227/67 |
| 5,697,591 | A | | 12/1997 | Cooper | 248/229.16 |
| 5,752,297 | A | | 5/1998 | Ramey | 24/462 |
| 5,826,629 | A | | 10/1998 | West | 140/119 |
| 5,881,452 | A | | 3/1999 | Nowell, III et al. | 29/816 |
| 5,893,252 | A | | 4/1999 | Hardy et al. | 52/685 |
| 5,938,099 | A | | 8/1999 | Ciccarelli | |
| 6,148,488 | A | | 11/2000 | Gristock | 24/462 |
| 6,276,108 | B1 | | 8/2001 | Padrun | 52/684 |
| 6,298,525 | B1 | * | 10/2001 | Margo | 24/336 |
| 6,354,054 | B1 | | 3/2002 | Verelli et al. | 52/686 |
| 6,371,763 | B1 | | 4/2002 | Sicurelli, Jr. et al. | 433/220 |
| 6,513,555 | B1 | | 2/2003 | Lesser et al. | 140/123.6 |
| 6,585,142 | B1 | | 7/2003 | Chen | 227/130 |
| 6,672,498 | B2 | | 1/2004 | White et al. | 227/120 |
| 6,725,535 | B2 | | 4/2004 | Edson et al. | 29/809 |
| 6,857,246 | B2 | | 2/2005 | Erbetta et al. | 52/653.2 |
| 6,915,624 | B2 | | 7/2005 | Shibazaki et al. | 53/588 |
| 6,925,698 | B2 | | 8/2005 | Goodsmith et al. | 29/432.1 |
| 6,971,515 | B2 | | 12/2005 | Cooper et al. | 206/343 |
| 7,003,860 | B2 | | 2/2006 | Bloch et al. | 29/407.1 |
| D529,794 | S | | 10/2006 | Murray | D8/396 |
| 7,143,563 | B1 | * | 12/2006 | Palmer | 52/677 |
| 7,147,209 | B2 | | 12/2006 | Jones et al. | 254/25 |
| D534,418 | S | | 1/2007 | Minor et al. | D8/396 |
| 2003/0154579 | A1 | | 8/2003 | Disher | 24/462 |
| 2004/0040247 | A1 | | 3/2004 | Morse | 52/649.8 |
| 2004/0154261 | A1 | | 8/2004 | Miller | 52/719 |
| 2004/0261352 | A1 | | 12/2004 | Bennett et al. | 52/698 |
| 2005/0217198 | A1 | | 10/2005 | Carraher et al. | 52/719 |
| 2006/0059850 | A1 | * | 3/2006 | Minor | 52/740.1 |
| 2006/0248844 | A1 | | 11/2006 | Kodi | 52/712 |
| 2007/0284385 | A1 | | 12/2007 | Carraher et al. | |
| 2008/0118304 | A1 | | 5/2008 | Carraher et al. | |

FOREIGN PATENT DOCUMENTS

| | | | |
|---|---|---|---|
| WO | 2006031407 | A2 | 3/2006 |
| WO | WO 2006031407 | A2 * | 3/2006 |
| WO | WO 2006033883 | A2 * | 3/2006 |

OTHER PUBLICATIONS

U.S. Appl. No. 11/142,539, filed Jun. 1, 2005 by Jon Kodi. (not prior art).

Exhibit A: Jiffy Clip Long Gun Applicator by Jiffy Clip, Inc. (see www.jiffyclip.com) (undated but admitted to be prior art).

Office Action dated May 25, 2010 from related co-pending U.S. Appl. No. 11/622,674. (not prior art).

* cited by examiner

BAR CONNECTING APPARATUS

CROSS-REFERENCES TO RELATED APPLICATIONS

This application is a Continuation-In-Part of co-pending U.S. Non-Provisional patent application Ser. No. 11/622,674 filed Jan. 12, 2007, entitled "BAR CONNECTING APPARATUS" which is hereby incorporated by reference. This application and application Ser. No. 11/622,674 both claim the benefit of co-pending U.S. Provisional Patent Application Ser. No. 60/860,434 filed Nov. 21, 2006, entitled "CLIP APPLYING APPARATUS" which is hereby incorporated by reference. The present application also claims benefit of co-pending U.S. Provisional Patent Application Ser. No. 60/911,401 filed Apr. 12, 2007 entitled "BAR CONNECTING APPARATUS" which is hereby incorporated by reference.

BACKGROUND OF THE INVENTION

1. Field of the Invention

The present invention relates to an apparatus and method for attaching clips to connect bars, wherein the bars are used to reinforce concrete. Reinforcing bars are commonly placed within a frame where cement is to be poured, so that the reinforcing bars will become encased in the poured cement. The reinforcing bars are placed in specified positions at specified heights within the frame, so the resulting concrete is strengthened. One method used to connect the reinforcing bars before the cement is poured is clips. These clips are attached at the intersection of two bars, so the bars are held together in a fixed position. The current invention provides an apparatus and a method for attaching clips to intersecting bars.

2. Description of the Related Art

Supporting bars are commonly used to reinforce concrete. The supporting bars are laid out in a grid where the cement is to be poured. To maximize the effectiveness of the supporting bars, they are placed at specified heights, usually between about 2 and 6 inches from the ground. The bars are then connected so the grid is stable and will not move when the concrete is poured.

Many methods have been used to connect the bars, and many are done by hand. Rebar is the type of supporting bar most commonly used. When the rebar is connected by hand, it requires a laborer to bend over and connect the rebar at many points within the grid. This is labor intensive, slow, and tends to cause injuries from the repeated bending. In some instances, the rebar grid can be prepared first, and then placed into a form where the concrete will be poured. This can reduce the bending required, but does not address the time and labor needed to connect the rebar. To reduce the time needed to connect rebar and to minimize the time a laborer is working in a stooped over position, several applicators for connecting the rebar have been developed.

For example, in U.S. Pat. No. 5,881,452 Nowell et al. describes an apparatus for applying deformable metal fastener clips to concrete reinforcement steel. The Nowell device is a hand held applicator. It applies generally U-shaped deformable metal clips at the intersection of pieces of reinforcing rebar or wire mesh sheets. The apparatus is used to place the U-shaped metal clip around adjacent metal bars and then deform and close the U, thus connecting the bars.

West, in U.S. Pat. No. 5,826,629, describes a pneumatic wire tying apparatus for tying crossed reinforcing bars together. This device has a guide member which opens to receive intersecting bars, and then closes onto the bars. In the closed position a length of wire is guided around the bars. A feed mechanism feeds a wire to the guide member, and a twist member engages and twists the wire around the reinforcing bars.

BRIEF SUMMARY OF THE INVENTION

The current invention relates to an apparatus for applying clips to connect reinforcing bar as is typically used in concrete structures. The bar connecting apparatus as described is designed to fasten plastic clips as defined in U.S. patent application publication number 2006-0248844 A1, which is incorporated herein by reference. The clips are inserted into a barrel, and the apparatus is positioned over transverse supporting bars. A hammer reciprocates longitudinally within the barrel and strikes the clip. The hammer propels the clip out of the distal end of the barrel, which is positioned over the transverse bars, such that the clip engages and connects the bars. An alignment head at the distal end of the barrel is utilized to position the bar connecting apparatus relative to the transverse bars.

The clips are provided in a clip string, which is a plurality of clips connected together. In one embodiment, the clips are connected directly to each other, and in another embodiment the clips are connected to a common feed rod. The clip string is inserted into a clip feed assembly, which directs a clip into a clip receiving cavity in the barrel each time the hammer reciprocates. The clip feed assembly engages the hammer through a cam guide, so the motion of the hammer as it reciprocates provides the drive to cycle the clip feed assembly. Therefore, each time the hammer propels a clip from the barrel, the clip feed assembly inserts another clip from the clip string into the barrel, so the bar connecting apparatus can connect several pairs of transverse bars in rapid succession.

The clip feed assembly utilizes at least one finger to engage and advance the clip string into the clip receiving cavity. The finger has a pivot point and a sloped side so the finger can ratchet backwards along the clip string before engaging and urging the clip string forward into the clip receiving cavity. The backwards ratcheting motion and forward engaging motion allows the finger to advance clips into the clip receiving cavity as the clip feed assembly reciprocates laterally with each cycle of the hammer.

The clip feed assembly includes a clip track, which supports the clip string outside of the clip receiving cavity. In one embodiment, the clip track engages the clip from the top, and the clip track extends through the clip receiving cavity. The hammer has an indentation with legs, so the clip track is received in the indentation with the hammer legs passing beside the clip track. The legs contact and drive the clip from the barrel. In a second embodiment, the clip track terminates before entering the clip receiving cavity, and a resilient retainer is utilized to hold the clip in place until it is driven from the bar connecting apparatus.

The hammer is reciprocated by a drive, which can be powered by many sources, including manual and pneumatic sources. The power source first biases the drive and the connected hammer distally to drive a clip from the barrel. Next, the drive and hammer are biased proximally to reposition the hammer for the next clip, and to complete the associated cycling of the clip feed assembly. A handle and a biasing spring are used for the manual embodiment, and a trigger is used to actuate a pneumatic or other power source.

DETAILED DESCRIPTION OF THE INVENTION

Clip String

Figure 1:
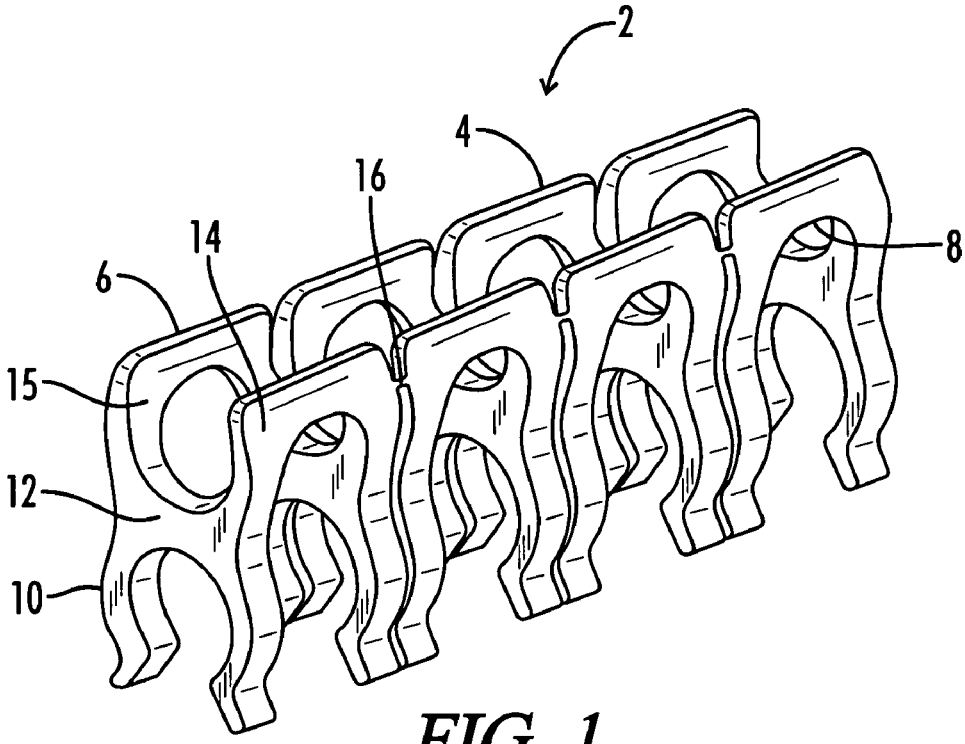
FIG. 1 is a perspective view of the clip string.
Figure 2:
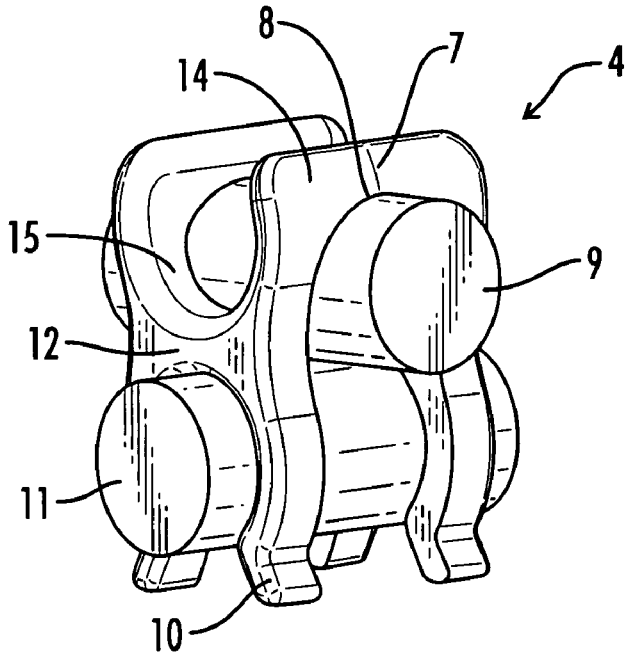
FIG. 2 is a perspective view of a single clip engaged with transverse bars.

The Bar Connecting Apparatus utilizes a clip string 2 as depicted in FIG. 1. The clip string 2 is comprised of a plurality of connected individual clips 4, wherein the last clip in the series is the terminal clip 6. In the preferred embodiment, the clips 4 are comprised of plastic and each clip 4 has several components. Referring to FIG. 2, the seat 8 is adapted to engage and position a first bar 9. Below the seat 8 are a plurality of hooks 10, preferentially four hooks 10 per clip 4, which are adapted to engage and position a second bar 11 transverse to the first bar 9. The first bar 9 is also positioned on top of the second bar 11. The hooks 10 are joined by a joining portion 12, and each hook 10 has an upper body 14.

The upper body 14 combined with the upper portion of the joining portion 12 defines a cradle 15 for engaging and positioning another bar parallel to and above the second bar 11. The clip 4 can position a bar parallel to the second bar 11 in the cradle 15, or it can position a first bar 9 in the seat 8, but not both at the same time because the seat 8 and the cradle 15 receive bars in areas which interfere with each other.

Each clip 4 in the clip string 2 is connected to at least one adjoining clip 4 at the connection point 16, as seen in FIG. 1. The connection point 16 can be defined anywhere on the portion of a clip that abuts an adjoining clip 4, as long as the clips 4 are connected together. Each clip 4 has at least one connection point 16, but multiple connection points 16 can be utilized if necessary. The clips 4 are connected such that every clip 4 in the clip string 2 has a consistent orientation. Preferably, the orientation is such that if a bar were received in the hooks 10 of the terminal clip 6, the same bar could be simultaneously received in the hooks 10 of every other clip 4 in the clip string 02. Therefore, there would be one axis defined by the hooks 10 of all of the clips 4 in a clip string 02. Similarly, the cradles 15 defined by the upper bodies 14 of the clips 4 would also be aligned on a single axis.

Figure 3:
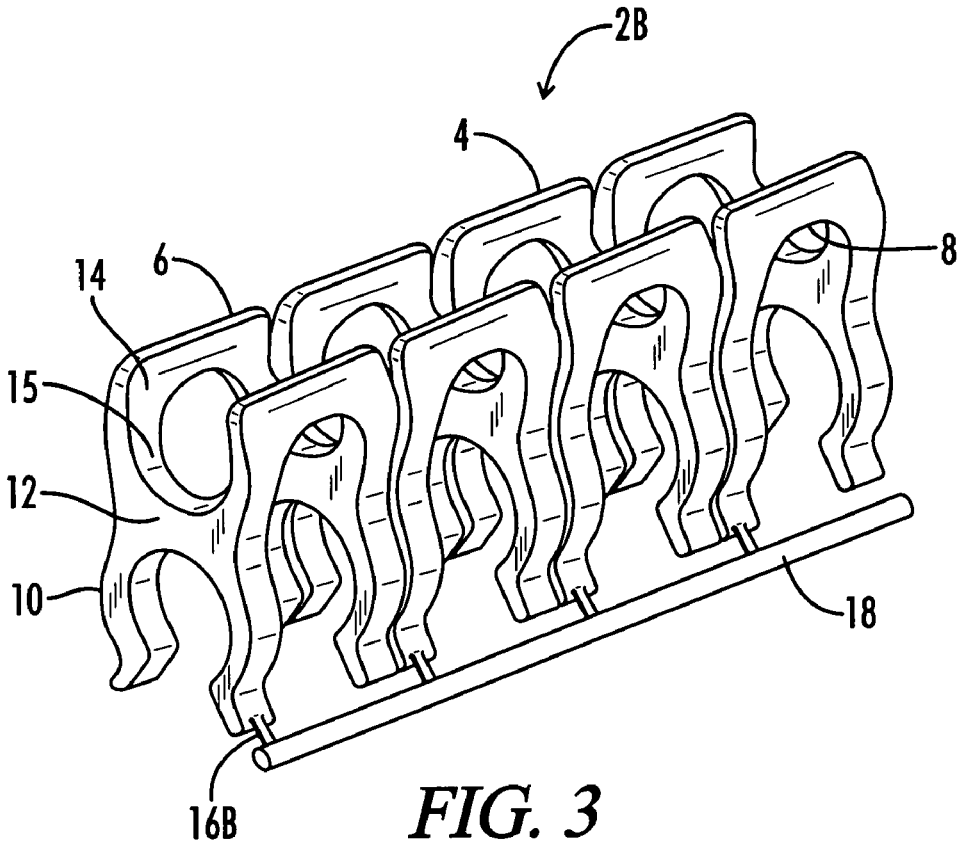
FIG. 3 is a perspective view of the clip string when the feed rod is utilized.
Figure 4:
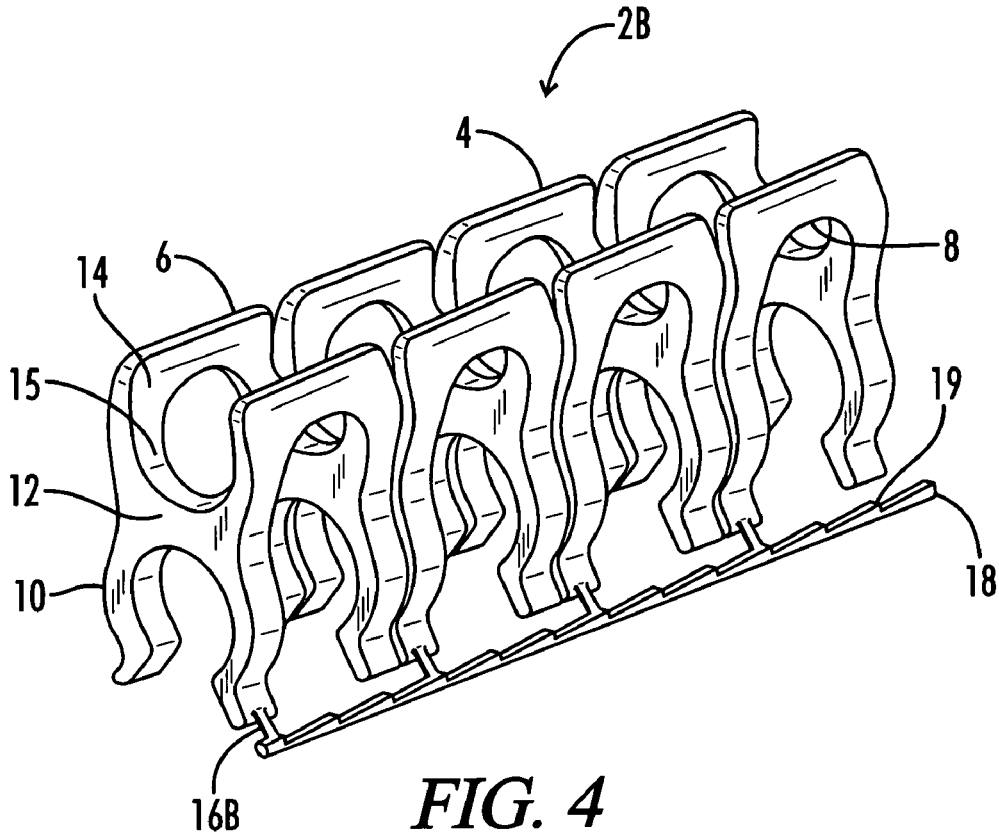
FIG. 4 is a perspective view of the clip string with teeth on the feed rod.

In an alternative embodiment, the clips 4 as defined above are connected to a feed rod 18, as depicted in FIG. 3. If the feed rod 18 is utilized, the connection point 16B connects each clip 4 to the feed rod 18. The feed rod 18 can be positioned anywhere along the side of the clip string 2B as long as the clips 4 are held in a consistent orientation as described above. It is possible for the feed rod 18 to have teeth 19 for advancing the clip string 2B, as shown in FIG. 4. Also, if the feed rod 18 is utilized, each individual clip 4 does not necessarily touch or directly contact the neighboring clip 4. The clips 4 are connected to the feed rod 18, and not to each other, so the clips 4 are not held in direct contact with other clips 4 in the clip string 2B.

Every clip string 2B has only one sized clip 4, but every clip string 2B does not necessarily have the same sized clip 4. The clips 4 are sized to connect a certain size of reinforcing bar, and because there are several sizes of reinforcing bars, there are several sizes of clips 4. Although the size of a clip 4 in different clip strings 2B would vary, the feed rod 18 allows the spacing between neighboring clips 4 to be constant. That is, the distance from the front of a larger clip 4 to the front of a neighboring larger clip 4 in one clip string 2B would be the same as the distance from the front of a smaller clip 4 to the front of a neighboring smaller clip 4 in another clip string 2B. When a feed rod 18 is utilized, this consistent spacing is possible because the clips 4 do not have to touch to be connected together. The consistent spacing is desirable because it allows for a bar connecting apparatus to apply clips 4 of different sizes without having to adjust or change the clip feed mechanism.

Figure 16:
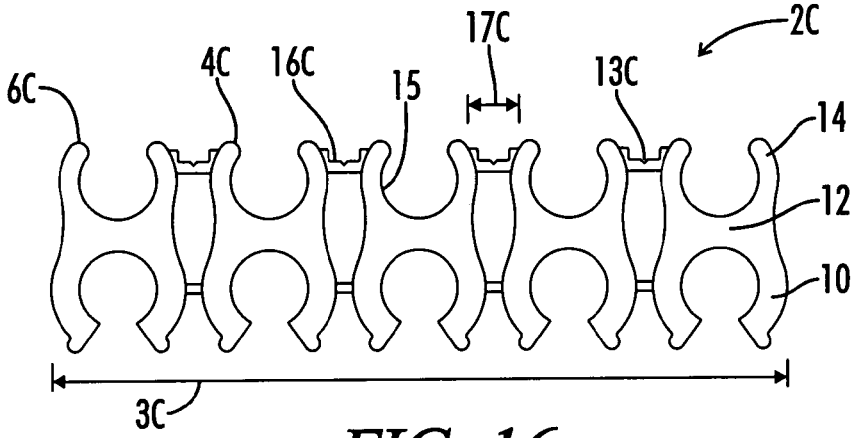
FIG. 16 is a side view of an embodiment of the clip string.

A third embodiment of the clip string 2C is shown in FIG. 16. Similar components are given the same names, but the identification numbers are denominated by a "C," for the sake of clarity. Every clip 4C in a clip string 2C is the same size, but the third embodiment allows for clips strings 2C having different sized clips 4C to maintain consistent spacing between the clips 4C without the use of a feed rod.

The clip string 2C has a length 3C, with each individual clip 4C having at least one adjacent clip. The terminal clip 6C would only have one adjacent clip 4C, whereas each clip 4C in the middle of the clip string 2C would have two adjacent clips 4C. Each clip 4C is oriented with the cradle 15 defined by the upper body 14 aligned perpendicular to the clip string length 3C. When the cradle 15 is perpendicular to the clip string length 3C, a bar received in the cradle 15 of the clip 4C would be perpendicular to the length 3C of the clip string 2C. This orientation is ninety degrees from the orientation shown in FIG. 1, where a bar received in the cradle 15 of each clip 4 would be parallel to the length of the clip string. In FIG. 16 each clip 4C is still consistently oriented, but the orientation has shifted. It is also possible to orient each clip 4C with the cradle 15 aligned parallel to the length 3C of the clip string 2C.

Consistent spacing between different sized clips 4C in different clip strings 2C is achieved by providing a connection point 16C with a length 17C. The connection point 16C is also referred to as a tab 16C, and the length 17C of the tab 16C varies between clip strings 2C having clips 4C of different size. By providing shorter tabs 16C for clip strings 2C with larger clips 4C, the spacing between the clips 4C can be kept consistent for clip strings 2C having different sized clips 4C. Therefore, the distance from the front of one clip 4C to the front of an adjacent clip 4C is the same for two different clip strings 2C which have clips 4C of different sizes. The length 17C of the tab 16C serves to hold adjacent clips 4C apart, so they don't touch, with the adjacent clips 4C separated by the tab length 17C. When the clip string 2C is flexed, adjoining clips 4C may touch, but normally they would be apart.

The tab 16C has an indent 13C to facilitate breaking of the tab 16C when the clip 4C is applied to connect bars. The terminal clip 6C becomes separated from the clip string 2C when used to connect bars, and the indent 13C provides a breaking point on the tab 16C to aid in separating the terminal clip 6C. Each clip 4C is comprised of plastic, and preferably includes four hooks 10, 4 upper bodies 14, and two joining portions 12 which each connects two hooks 10, as best seen in FIG. 2. Each upper body 14 is connected to one other upper body 14 in each clip 4.

Bar Connecting Apparatus

Figure 5:
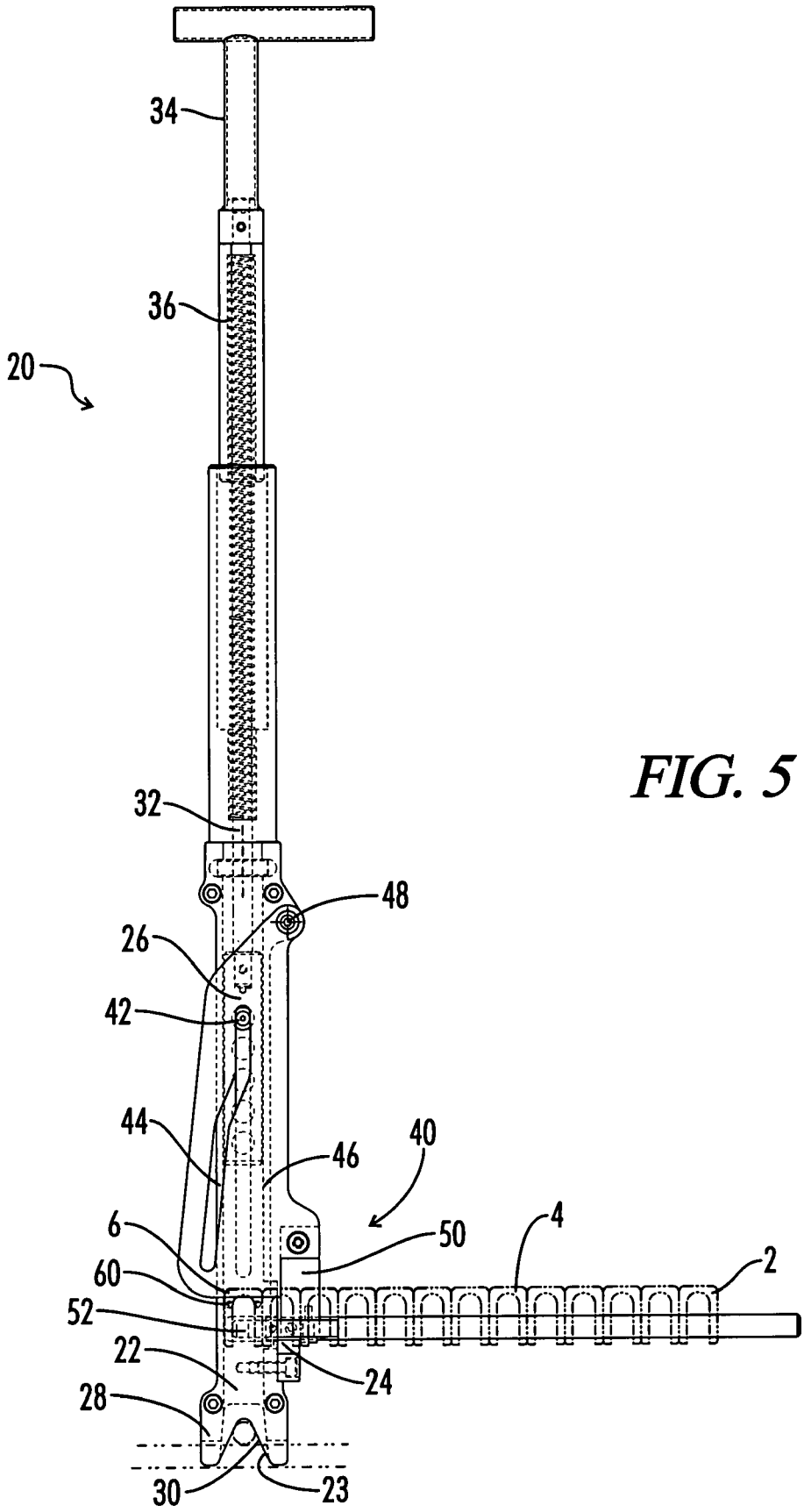
FIG. 5 is a side view of the manually driven embodiment of the bar connecting apparatus.
Figure 6:
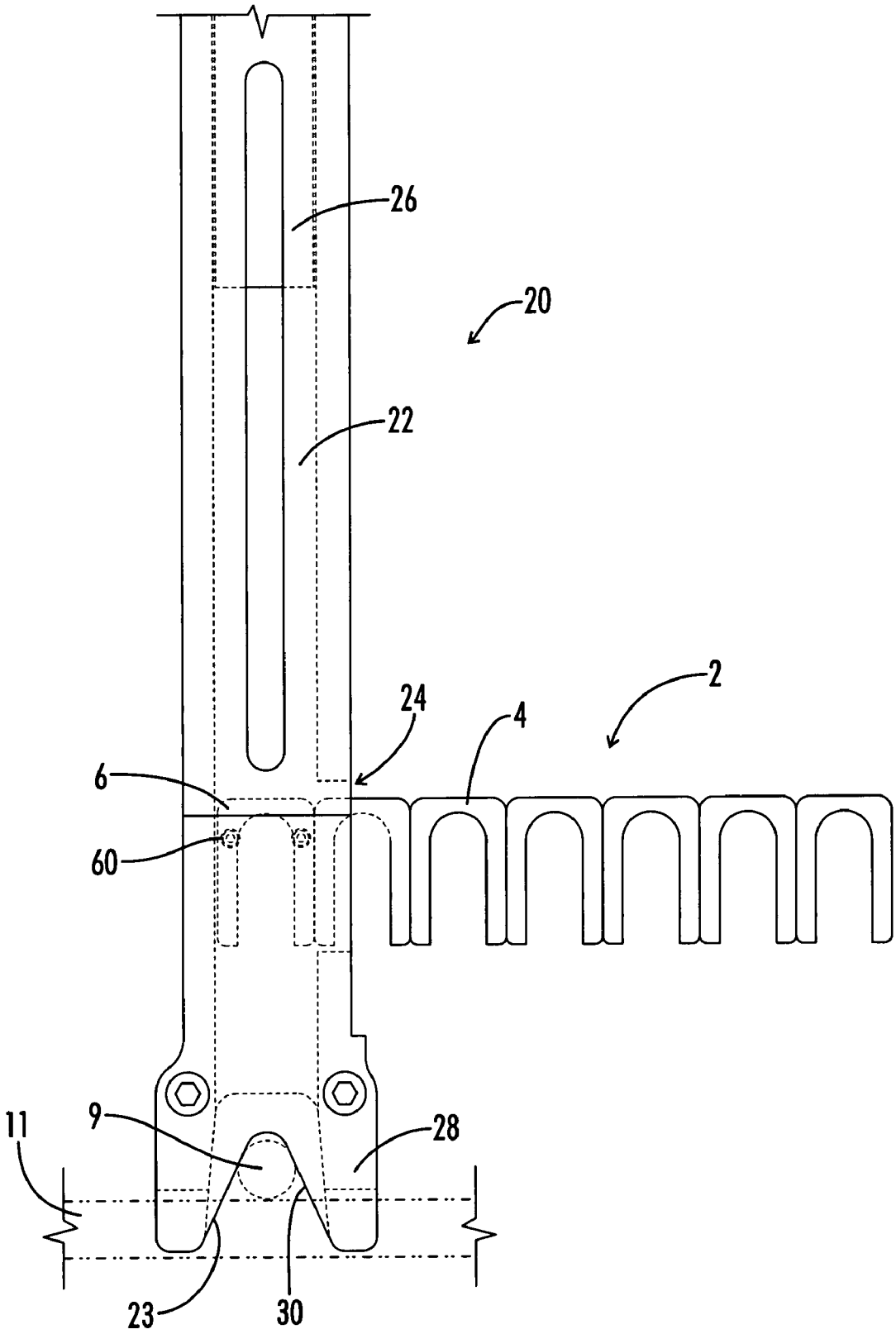
FIG. 6 is a side view of a distal portion of the bar connecting apparatus without the clip feed assembly.

The clip string 2 is utilized in the bar connecting apparatus 20 as shown in FIG. 5. Inside the bar connecting apparatus 20 is a barrel 22 with a clip receiving cavity 24. The terminal clip 6 of the clip string 2 is received into the clip receiving cavity 24 of the barrel 22, which can be seen more clearly in FIG. 6. FIG. 6 does not include the clip feeding mechanism, to more clearly show the barrel 22 with the clip receiving cavity 24. The clip receiving cavity 24 includes a hole in the side of the barrel 22 which is adapted to receive clips 4 from the clip string 02. Inside the barrel 22 is a hammer 26 which reciprocates longitudinally within the barrel 22. As the hammer 26 reciprocates distally, it contacts the terminal clip 6 and expels the terminal clip 6 out the distal end of the barrel 23.

There is an alignment head 28 defined at the distal end of the barrel 23, which aligns the clip applying apparatus 20 with the bars to be connected. When the terminal clip 6 is ejected from the barrel 22, the alignment head 28 ensures the bar connecting apparatus 20 is properly aligned with the bars such that the terminal clip 6 connects the bars. After the terminal clip 6 is ejected the hammer 26 reciprocates proximally, the next clip 4 in the clip string 2 is advanced into the clip receiving cavity 24 and becomes the new terminal clip 6, and the clip applying process is ready to be repeated.

Figure 7:
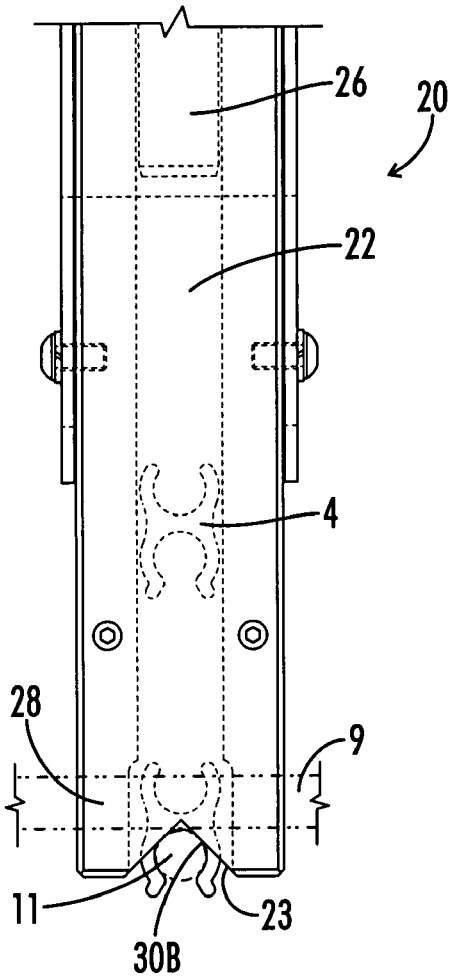
FIG. 7 is a front view of a distal portion of the bar connecting apparatus without the clip feed assembly.

The alignment head 28 has two pair of notches 30, 30B adapted to engage transverse bars, as seen in FIGS. 6 and 7. For the sake of clarity, FIG. 7 also does not show the clip feeding mechanism. One pair of notches 30 is deeper than the other pair 30B, so the first bar 9, which is on top, is engaged in the deeper pair of notches 30 and the second bar 11, which is underneath the first bar 9, is engaged in the more shallow pair of notches 30B. The notches 30, 30B in each pair are on opposite sides of the alignment head 28, so the four points of contact between the notches 30, 30B and the transverse bars 9, 11 prevent the bar connecting apparatus 20 from moving. The alignment head 28, when engaged with the transverse bars, fixes the position of the bar connecting apparatus 20 in three dimensions.

Figure 8:
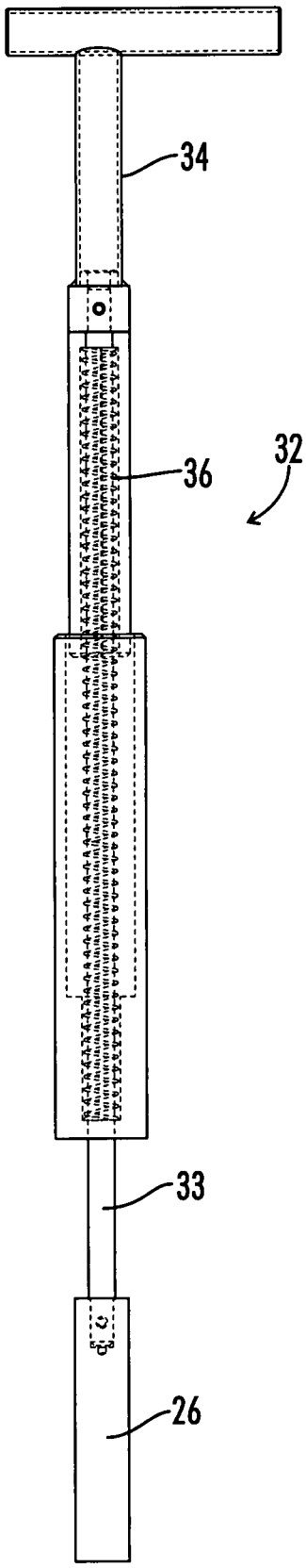
FIG. 8 is a side view of the manual drive portion of the bar connecting apparatus with an attached hammer.

The hammer 26 is reciprocated by a drive 32, as seen in FIGS. 5 and 8. FIG. 8 depicts the hammer 26 and the manual drive 32, without the remainder of the bar connecting apparatus 20. The drive 32 includes a drive rod 33 which is actuated either manual or automatically. The act of connecting the drive rod 33 to the hammer 26 can be aided by wrench flats in the drive rod 33. In the manual embodiment, the drive 32 includes a handle 34 and a biasing spring 36. The handle 34 is manually depressed to extend the hammer 26 distally for ejecting the terminal clip 6 from the barrel 22. The biasing spring 36 then biases the handle 34 proximally and retracts the hammer 26 to a position such that the next terminal clip 6 can be introduced into the clip receiving cavity 24.

Figure 9:
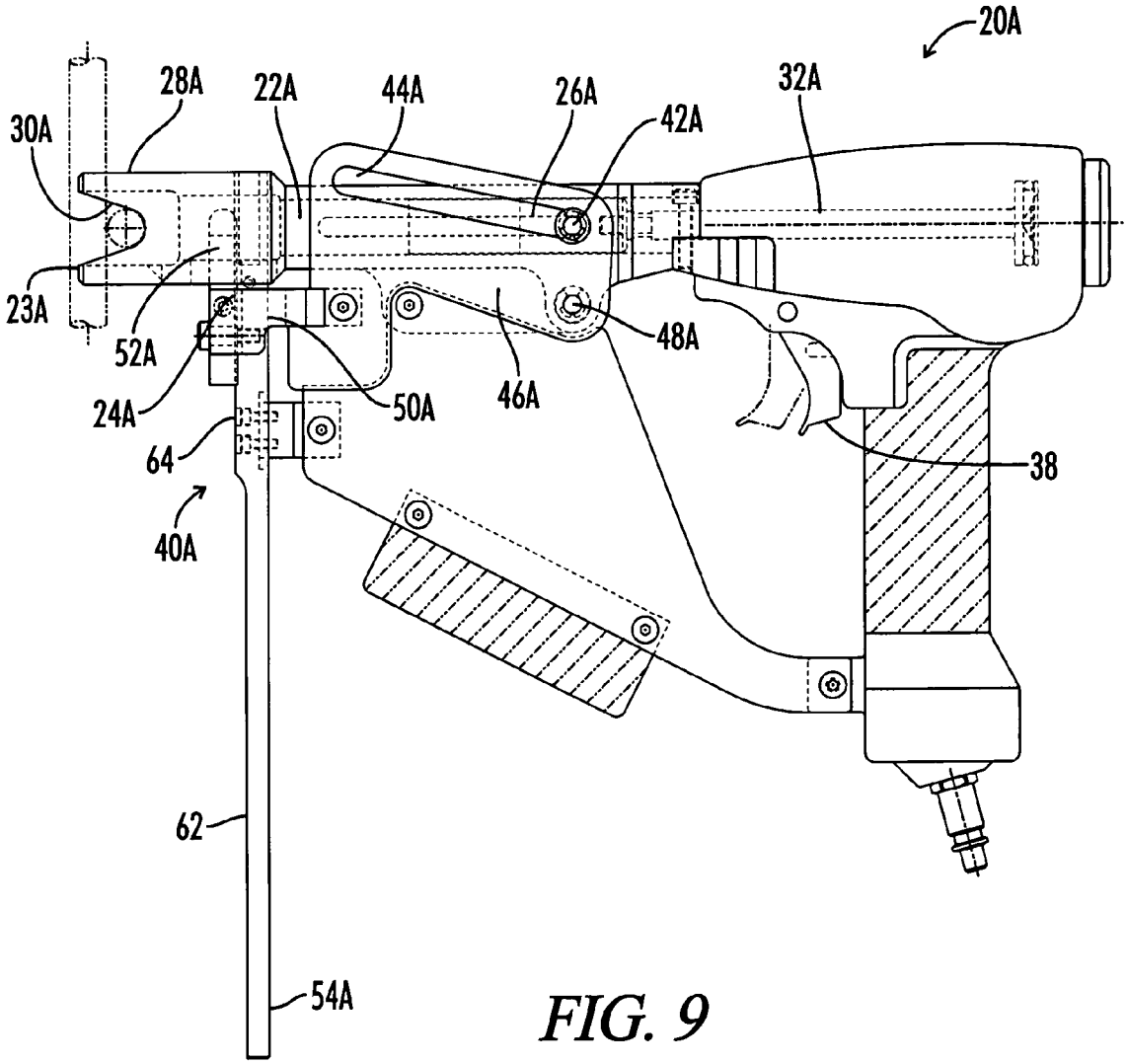
FIG. 9 is a side view of the pneumatically driven embodiment of the bar connecting apparatus.

FIG. 9 depicts the bar connecting apparatus 20A with a trigger actuated automatic drive 32A. For the sake of clarity, similar components in the manual and automatic embodiments are given the same name and number, but the component numbers in the automatic embodiment are designated with an "A." The drive 32A includes a trigger 38 for directing a power source to cycle the drive 32A, such that the power source biases the drive 32A distally when the trigger 38 is depressed and proximally when the trigger 38 is released. In the preferred embodiment, the power source is pneumatic; however, other power sources, such as an electric power source, could also be utilized. Additionally, an extension can be added to either the automatic or manual drive 32, 32A so an operator can stand upright while connecting bars.

The alignment head 28 includes two pair of notches 30, 30B, which are further designated as a first and second pair of notches 30, 30B, as seen in FIGS. 6 and 7. The first pair of notches 30 are deeper than the second pair of notches 30B. This allows the first transverse bar 9, which is above the second bar 11, to be engaged in the first pair of notches 30, and the second, bottom transverse bar 11 to be engaged in the second pair of notches 30B. The transverse bars 9, 11 are perpendicular to each other, and the alignment head 28C positions the barrel 22C perpendicular to both bars 9, 11.

Clip Feed Assembly

Figure 10:
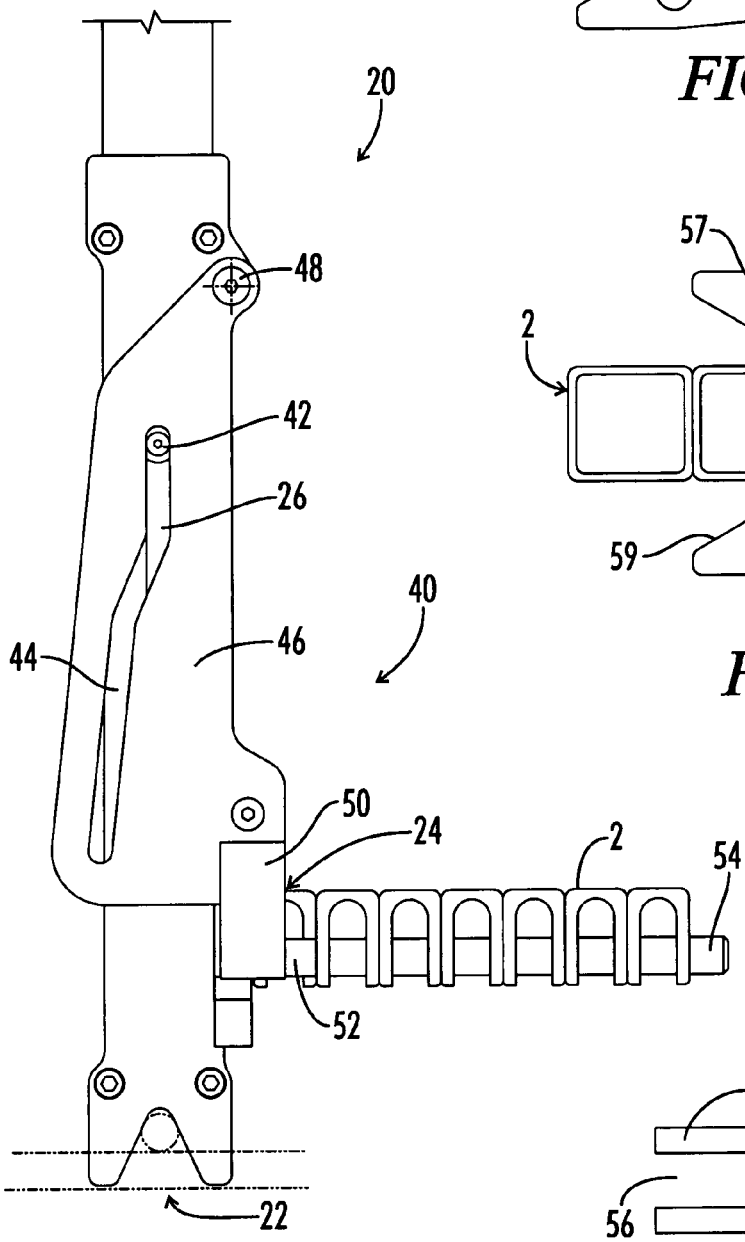
FIG. 10 is a side view of a distal portion of the bar connecting apparatus.

The clip feed assembly 40 advances the clip string 2 into the clip receiving cavity 24 as the hammer 26 reciprocates, as seen in FIG. 10. A cam guide 42 is connected to the side of the hammer 26. The cam guide 42 passes through a straight slot and protrudes from the side of the barrel 22. Therefore, the cam guide 42 reciprocates outside of the barrel 22 as the hammer 26 reciprocates inside of the barrel 22. The cam guide 42 can include a bearing to make the motion of the cam guide 42 smoother.

The portion of the cam guide 42 which protrudes from the side of the barrel 22 is engaged in a slot type cam track 44. The cam track 44 is defined in the cam plate 46, and the cam plate 46 is pivotally connected to the bar connecting apparatus 20 at a pivot point 48. The cam track 44 has an angled section such that as the hammer 26 and cam guide 42 cycle, the cam plate 46 pivots at the pivot point 48 and reciprocates laterally. The cam track 44 can also include straight sections, which are used for timing purposes to coordinate the clip feed assembly 40 operation with the cycling of the hammer 26. The cam plate 46 reciprocates away from the barrel 22 as the hammer 26 reciprocates distally, and the cam plate 46 reciprocates towards the barrel 22 as the hammer 26 reciprocates proximally. With the slot type cam track 44 no return spring is needed for the cam plate 46.

Figure 15:
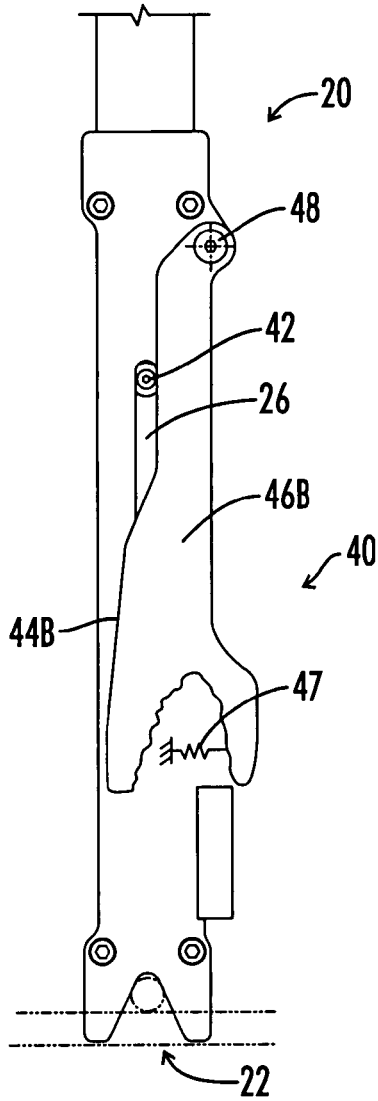
FIG. 15 is a side view illustrating an alternate design for the cam plate.

An alternate design for the cam plate, designated as 46B is shown in FIG. 15. Surrounding parts of apparatus 20 are not shown in FIG. 15 so as to aid in the ease of illustration of cam plate 46B. The cam plate 46B has an edge type cam track 44B instead of the slot 44 of FIG. 10. The edge type cam track 44B is maintained in contact with the reciprocating cam guide 42 by a tension spring 47, which is schematically illustrated in FIG. 15. Any type of resilient return spring could be utilized in place of spring 47 to urge the cam track 44B against cam guide 42. With either the cam plate 46 of FIG. 10 or the cam plate 46B of FIG. 15 the cam plate will reciprocate as the hammer 26 cycles.

Figure 11:
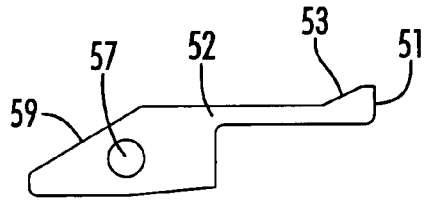
FIG. 11 is a top view of a finger of the clip feed assembly.
Figure 12:
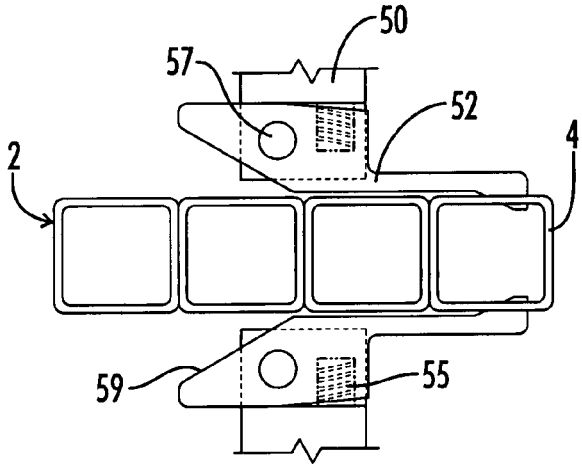
FIG. 12 is a top view of a clip string engaged by fingers of the clip feed assembly.

A feed support block 50 can be positioned at the end of the cam plate 46 to facilitate the feeding of the clip string 2 into the clip receiving cavity 24, as shown in FIG. 10. At least one finger 52, and preferably two fingers, is connected to the cam plate 46 through the feed support block 50. Referring to FIGS. 10, 11, and 12, the finger 52 has a flat end 51 for engaging the clip string 2 as the cam plate 46 reciprocates towards the barrel 22, but the finger 52 also has a sloped side 53 for sliding past the clip string 2 as the cam plate 46 reciprocates away from the barrel 22.

The finger 52 is pivotally connected to the feed support block 50 at a finger pivot point 57, and a biasing spring 55 urges the finger 52 to engage an individual clip 4 of the clip string 2 as the cam plate 46 reciprocates towards the barrel 22. The finger pivot point 57 allows the finger 52 to ratchet back past the clip string 2 as the cam plate 46 moves away from the barrel 22. Therefore, the clip string 2 sits still as the cam plate 46 reciprocates away from the barrel 22, but the clip string 2 is advanced into the clip receiving cavity 24 as the cam plate 46 reciprocates towards the barrel 22. The clip feed assembly 40 does not utilize a spring or urging device at the back end of the clip string 2 to advance the clips 4 into the clip receiving cavity 24. The above described mechanism engages the hammer 26 with the clip feed assembly 40 so the cycling of the hammer 26 provides the force to urge the clip string 2 into the clip receiving cavity 24.

In one embodiment, the finger 52 has an angled back end 59 which can be pressed to disengage the finger 52 from the clip string 2. When disengaged, the clip string 2 can be withdrawn from the clip receiving cavity 24 without the finger 52 retaining any of the individual clips 4.

Figure 13:
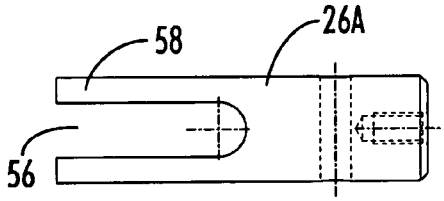
FIG. 13 is a side view of the hammer having an indentation.

The clip string 2 is supported by a clip track 54 when inserted into the bar connecting apparatus 20. The clip track 54 can engage the clip string 2 from either the top or the bottom. Referring now to FIGS. 1, 9, and 13, the clip track 54A can engage the clips 4 by the cradle 15 defined by the upper body 14, or from the top. When the clip string 2 is engaged from the top, the clip track 54A extends through the clip receiving cavity 24A. The clips 4 are then released distally from the clip track 54A. When the clip track 54A extends through the clip receiving cavity 24A, the hammer 26A has an indentation 56 for receiving the clip track 54A as the hammer 26A reciprocates. The hammer 26A has at least one, and preferably two, legs 58 on the side of the indentation 56. The legs 58 contact the upper body 14 of the terminal clip 6 to propel the clip out of the barrel 22A. As the legs 58 propel the terminal clip 6 out of the barrel 22A, the clip track 54A is received in the indentation 56 such that the legs 58 pass beside the clip track 54A.

Figure 14:
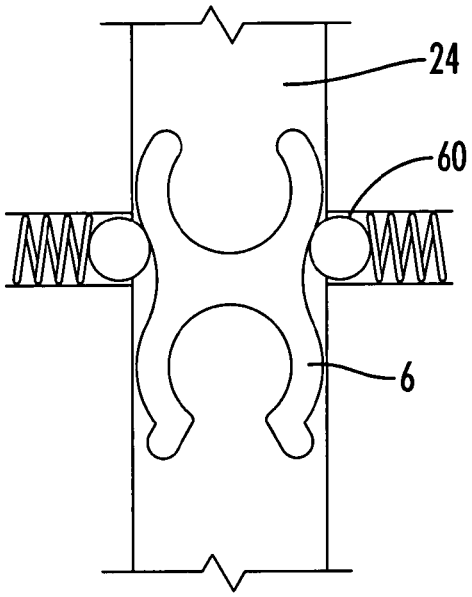
FIG. 14 is a front view of a portion of the clip receiving cavity with resilient retainers.

In the embodiment where the clip track 54 engages the clip string 2 from the bottom, the clip track 54 does not extend through the clip receiving cavity 24, as shown in FIGS. 5 and 10. The clip track 54 terminates at the clip receiving cavity 24 and the hammer 26 can be flat because there is no need to pass around the clip track 54. Referring to FIGS. 5, 10, and 14, because the clip track 54 does not hold the clip 4 in the clip receiving cavity 24, at least one resilient retainer 60 can be used to secure the terminal clip 6 in the clip receiving cavity 24. Preferably, four resilient retainers 60 comprised of ball bearing springs mounted in the clip receiving cavity 24 are used. The resilient retainer 60 releasably engages the terminal clip 6 in the clip receiving cavity 24 to prevent the terminal clip 6 from falling out of the barrel 22 before being expelled by the hammer.

Referring to FIGS. 1 and 9, the clip track 54A is further comprised of at least a first portion 62 and a second portion 64. The second portion 64 is dimensioned to frictionally engage and lightly hold the clip string 2. The first portion of the clip track 62 has smaller dimensions which do not frictionally engage or hold the clip string 2, so the clips 4 will easily slide across the first portion of the clip track 62. This allows the clips 4 to be easily engaged with the first portion of the clip track 62, and yet still be frictionally engaged and held in position by a shorter second portion 64. The second portion of the clip track 64 is between the barrel 22A and the first portion 62 so that the clip string 2 is frictionally engaged when in a position to enter into the clip receiving cavity 24A.

Clip Feed Assembly with a Hammer Plate

An alternate embodiment of the clip feed assembly is shown in FIGS. 17, 18, 19 and 20. In the description of this embodiment, similar components are given the same name and number, but are denoted by the suffix "C." In FIG. 18, the barrel has been removed to better show the internal parts.

Figure 21:
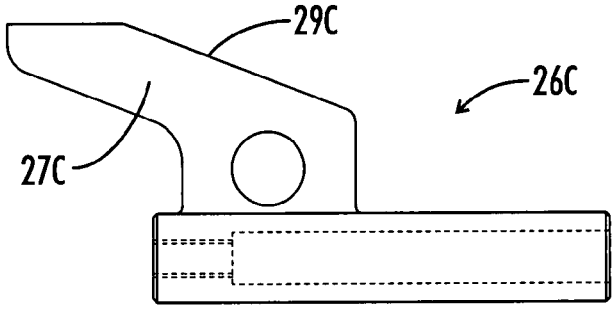
FIG. 21 is a side view of the hammer with the hammer plate.
Figure 22:
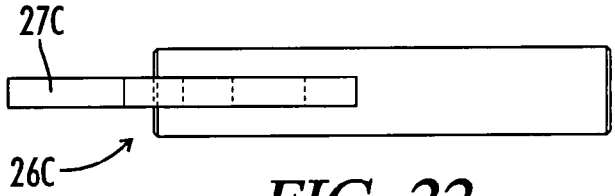
FIG. 22 is a top view of the hammer with the hammer plate.

A barrel 22C has a clip receiving cavity 24C and a slot 25C extending parallel to the length of the barrel 22C. The hammer 26C includes a hammer plate 27C, which extends through the barrel slot 25C. The hammer 26C reciprocates longitudinally within the barrel 22C, and the hammer plate 27C reciprocates external and parallel to the barrel 22C through the barrel slot 25C. The hammer plate 27C has an angled section 29C, which is angled relative to the length of the barrel 22C. This angled section 29C works as an inclined plane. The hammer 26C can be hollow and include holes to reduce weight, as better seen in FIGS. 21 and 22. The cycling of the hammer 26C provides the force to cycle the clip feed assembly 40C, which urges a clip 4C into the clip receiving cavity 24C.

Figure 23:
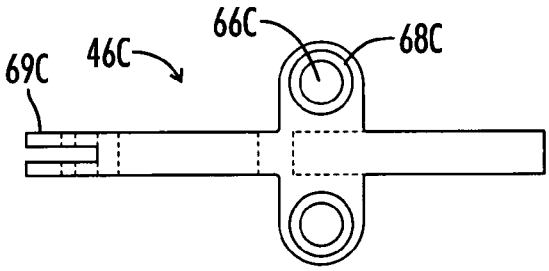
FIG. 23 is a top view of the cam plate for the hammer plate embodiment of the invention.
Figure 24:
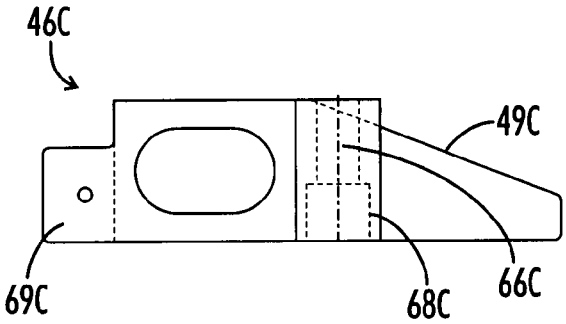
FIG. 24 is a side view of the cam plate for the hammer plate embodiment of the invention.

A cam plate 46C is shown in isolation in FIGS. 23 and 24. The cam plate has an inclined section 49C, at least one running fit 66C, and can include holes to reduce weight. The running fit 66C has a spring pocket 68C to receive and support a tension spring. The spring pocket 68C has a larger diameter than the running fit 66C. The inclined section 49C faces the angled section 29C of the hammer plate 27C, as better seen in FIGS. 17 and 18. The inclined section 49C is positioned to be angled relative to the length of the barrel 22C. A guide shaft 70C is received in each running fit 66C, and serves to guide the cam plate 46C as the cam plate 46C reciprocates. The guide shaft 70C is fixed in one position, so the cam plate 46C reciprocates parallel to the guide shaft 70C. The running fit 66C is dimensioned slightly larger than the guide shaft 70C, so the cam plate 46C will be held at a relatively constant angle to the guide shaft 70C as the cam plate 46C reciprocates up and down on the guide shaft 70C. In this embodiment, the cam plate 46C does not pivot on a pivot point.

Figure 27:
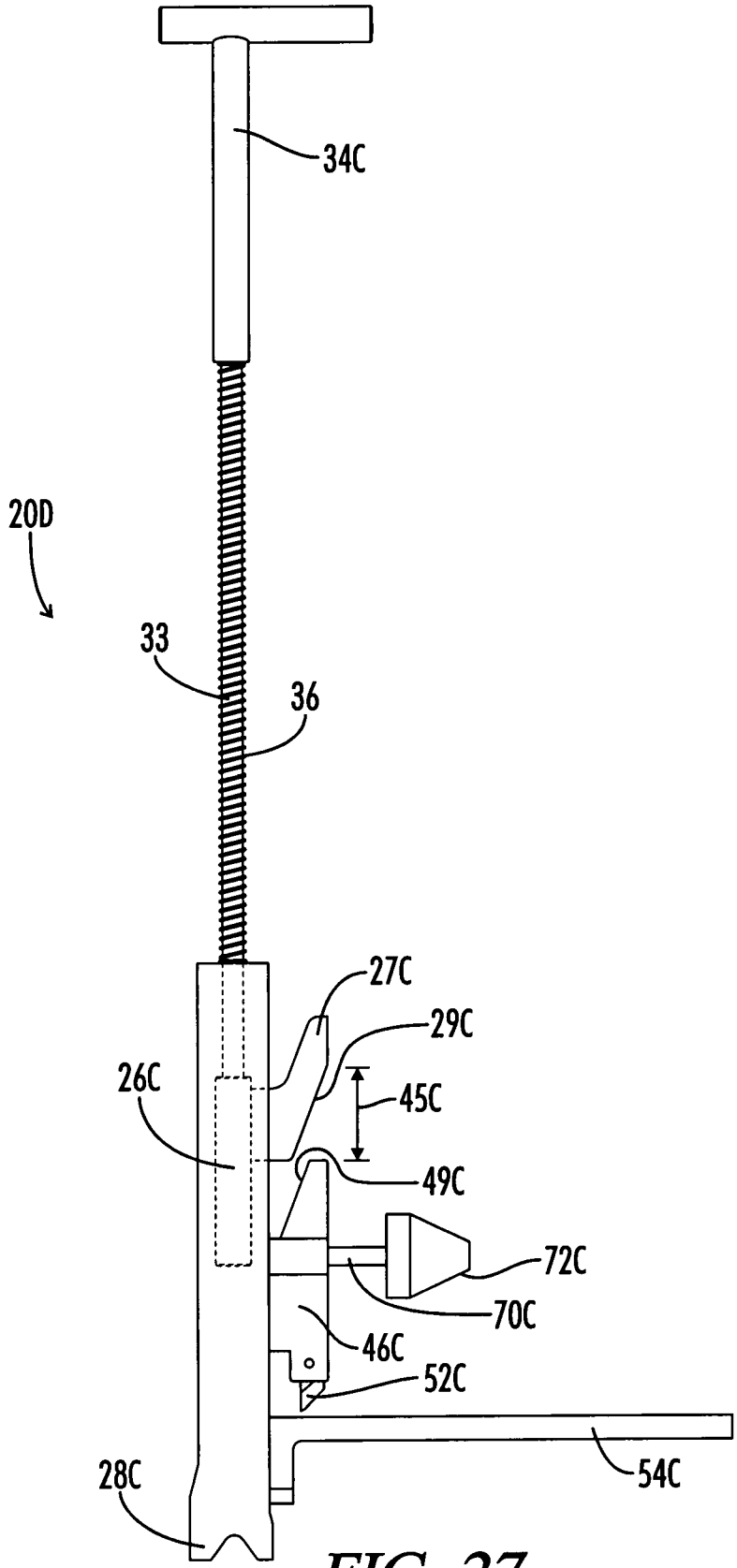
FIG. 27 is a side view of the hammer plate embodiment of a manually actuated bar connecting apparatus with the safety plate removed for clarity.

As seen in FIG. 27, a space 45C between the hammer plate 27C and the cam plate 46C, when the hammer 26C has reciprocated proximally, allows for the application of a smaller force to initiate the actuation motion of the hammer 26C, as shown in FIG. 27. This is because the hammer plate 27C will have developed some momentum when contacting and initiating the cycling of the cam plate 46C. This space 45C between the hammer plate 27C and cam plate 46C is especially useful for a manually actuated bar connecting apparatus 20D shown in FIG. 27, because it requires less strength from the operator. Even though there is a space 45C between the hammer plate 27C and the cam plate 46C, the angled section 29C and the inclined section 49C still face each other.

Referring again to FIGS. 17 and 18, the guide shaft 70C is received between the barrel 22C and a guide shaft bracket 72C. The guide shaft 70C has a first end 74C, which is connected and secured to the barrel 22C, and a second end 76C, which is secured to the guide shaft bracket 72C. A compression spring 47C is received about the guide shaft 70C. The compression spring 47C serves to urge the cam plate 46C towards the hammer plate 27C. The compression spring terminates on one end in the cam plate spring pocket 68C, and on the other end in a guide shaft bracket spring pocket 78C. The compression spring 47C could be mounted in many alternative ways, and it could assume a form different than a coil spring, as long as it biases the cam plate 46C towards the hammer plate 27C.

As the hammer 26C reciprocates distally, the angled section 29C of the hammer plate 27C pushes into the inclined section 49C of the cam plate 46C. The guide shaft 70C forces the cam plate 46C to only move parallel to the guide shaft 70C, so the force of the hammer plate angled section 29C on the cam plate inclined section 49C is translated into a lateral motion of the cam plate 46C along the guide shaft 70C. Therefore, as the hammer 26C reciprocates distally, the cam plate 46C reciprocates laterally away from the barrel 22C. When the hammer 26C reciprocates proximally, the compression spring 47C urges the cam plate 46C towards the hammer 26C, so the cam plate reciprocates laterally towards the barrel 22C.

At least one safety plate 80C is mounted to cover the workings of the hammer plate 27C and the cam plate 46C. Therefore, the safety plate 80C is adjacent to the hammer plate 27C and the cam plate 46C. The safety plate 80C is indicated by long and short dashed lines in FIGS. 17 and 19, with the parts underneath the safety plate 80C shown for clarity, even though the parts would not be visible underneath the safety plate 80C. Preferably, there would be a safety plate 80C on both sides of the bar connecting apparatus 20C, to provide better protection from the workings of the hammer plate 27C and the cam plate 46C. The safety plate 80C is connected to the barrel 22C, and serves as a mount for the guide shaft bracket 72C. It is also possible to connect a bracket 81C between the safety plate 80C and the handle 82C of the bar connecting apparatus 20C. The bracket 81C can include a grip 83C, if desired. The bracket 81C and grip 83C are shown in phantom lines in FIG. 17.

Figure 18:
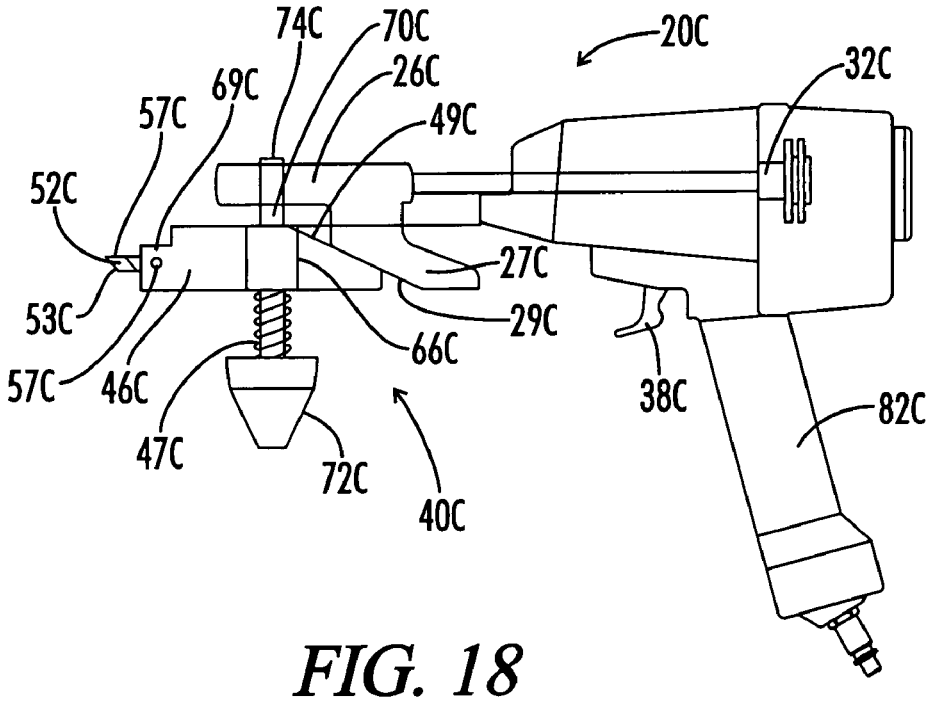
FIG. 18 is a side view of an embodiment of the bar connecting apparatus with the barrel removed to display components within the barrel.
Figure 25:
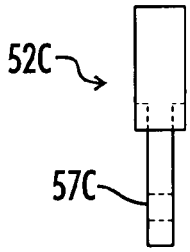
FIG. 25 is a rear view of the finger for the hammer plate embodiment of the invention.
Figure 26:
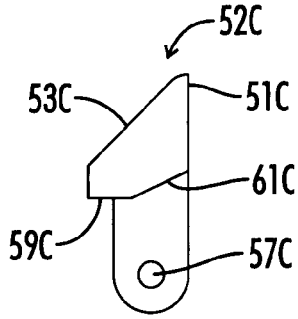
FIG. 26 is a side view of the finger for the hammer plate embodiment of the invention.

A finger 52C is pivotally connected to the cam plate 46C at the distal end of the cam plate 46C. The finger 52C is for engaging and advancing a clip 4C into the clip receiving cavity 24C with each reciprocation of the cam plate 46C. The finger 52C is shown in isolation in FIGS. 25 and 26. The finger 52C has a flat end 51C for engaging and advancing a clip. The finger 52C also has a sloped side 53C, to slide past a clip without engaging it. A catch portion 59C serves to support the finger 52C and prevent it from pivoting backwards, or towards the sloped side 53C, when engaging a clip and advancing it forwards. An angled portion 61C allows the finger to pivot forward, or towards the flat end 61C, when the finger 52C slides backwards past a clip to engage and advance a new clip forward. The finger 52C has a pivot point 57C, which is connected between two faces 69C on the cam plate 46C, as seen in FIGS. 23 and 26. The catch 59C abuts an edge of the cam plate faces 69C as seen in FIG. 18, which prevents the finger 52C from pivoting backwards. The angled section 61C abuts the edges of the cam plate faces 69C after the finger 52C has pivoted forward enough to allow the finger 52C to slide away from barrel 22C past a clip, so the forward pivoting of the finger 52C is controlled by the angled section 61C.

Figure 19:
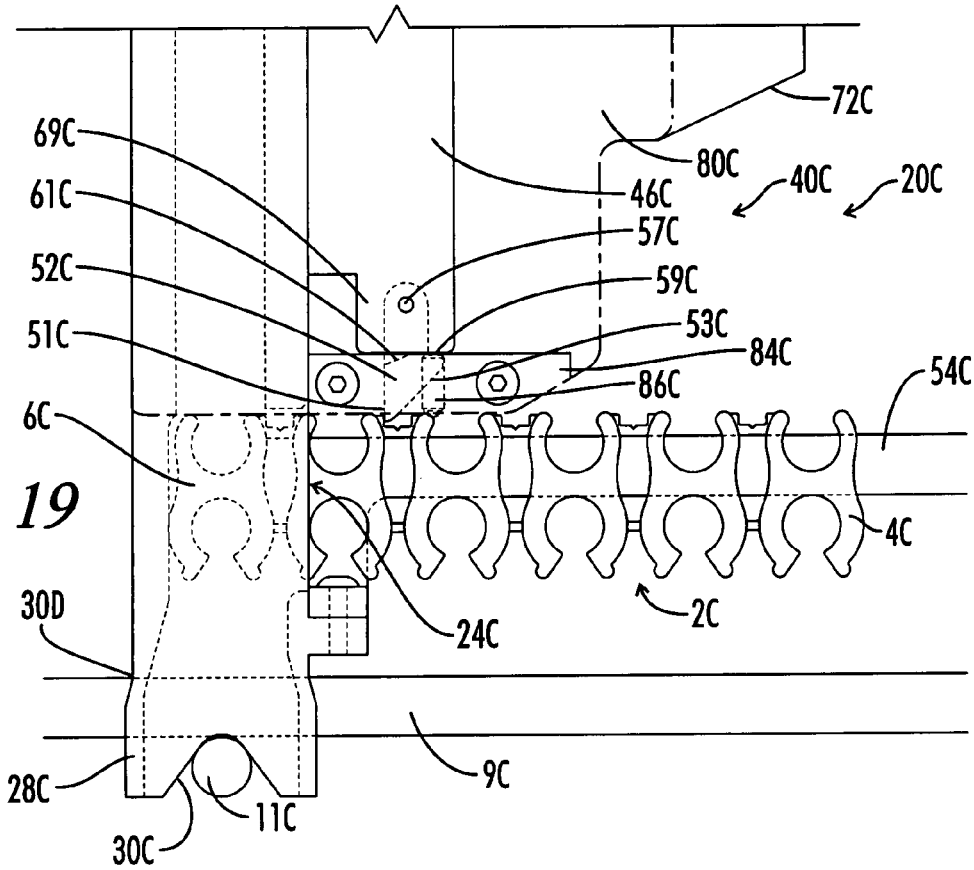
FIG. 19 is a side view of the distal portion of the bar connecting apparatus
Figure 20:
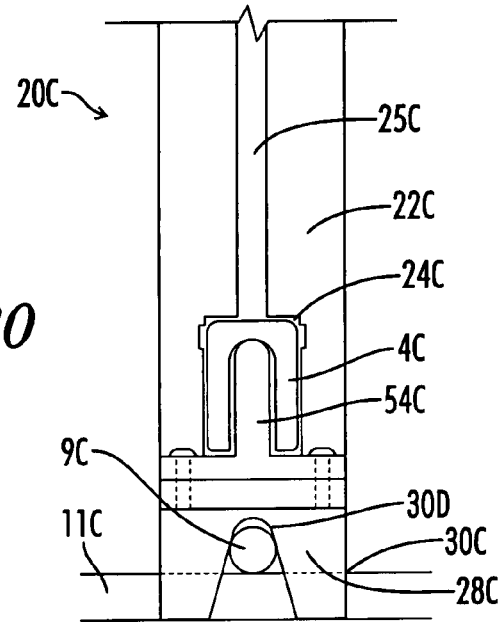
FIG. 20 is a rear view of the distal portion of the bar connecting apparatus, with the clip feed assembly removed for clarity.

Referring now to FIG. 19, the finger 52C is received between finger brackets 84C, which are mounted to the safety plate 80C. When the hammer moves distally the cam plate 46C moves away from the barrel 22C, and the acceleration of the cam plate 46C causes the finger 52C to pivot towards the barrel 22C on the finger pivot point 57C. When the hammer moves proximally, the cam plate 46C reverses direction and accelerates toward the barrel 22C. This acceleration causes the finger 52C to pivot away from the barrel 22C on the pivot point 57C. When the finger 52C pivots away from the barrel 22C, the flat end 51C is positioned to engage and advance a clip 4C towards the barrel 22C.

A resilient catch 86C is mounted in the finger bracket 84C. The resilient catch 86C is positioned to engage a clip 4C received on the clip track 54C and provide resistance to the clip 4C sliding backwards, or away from the barrel 22C. In particular, the resilient catch 86C contacts a surface of a clip 4C that is facing away from the barrel 22C. The resilient catch 86C is mounted in the finger bracket 84C, but it could be mounted anywhere, as long as it is positioned adjacent to the clip track 54C for contacting a surface of a clip 4C that is facing away from the barrel 22C. The resilient catch 86C provides some resistance, but will allow motion past it if sufficient force is applied.

A clip track 54C is connected to the barrel 22C adjacent to the clip receiving cavity 24C, but does not extend through the barrel 22C. The clip track 54C supports the clips 4C in the seat 8, so the connection point 7 between two upper bodies 14 is transverse to the clip track 54C, as seen in FIGS. 19, 2, and 16. The finger 52C engages this connection point 7, which provides a contact surface perpendicular to the motion of the finger 52C. This broad contact surface facilitates the use of different sized clips 4C in the same bar connecting apparatus 20C, because different sized clips will still have the connection point 7 positioned above the clip track 54C in the same manner. The finger 52C moves a set distance with each reciprocation of the cam plate 46C, so the consistent spacing of the clips 4C in the clip string 2C allows for different sized clips 4C to be used in the bar connecting apparatus 20C.

Figure 17:
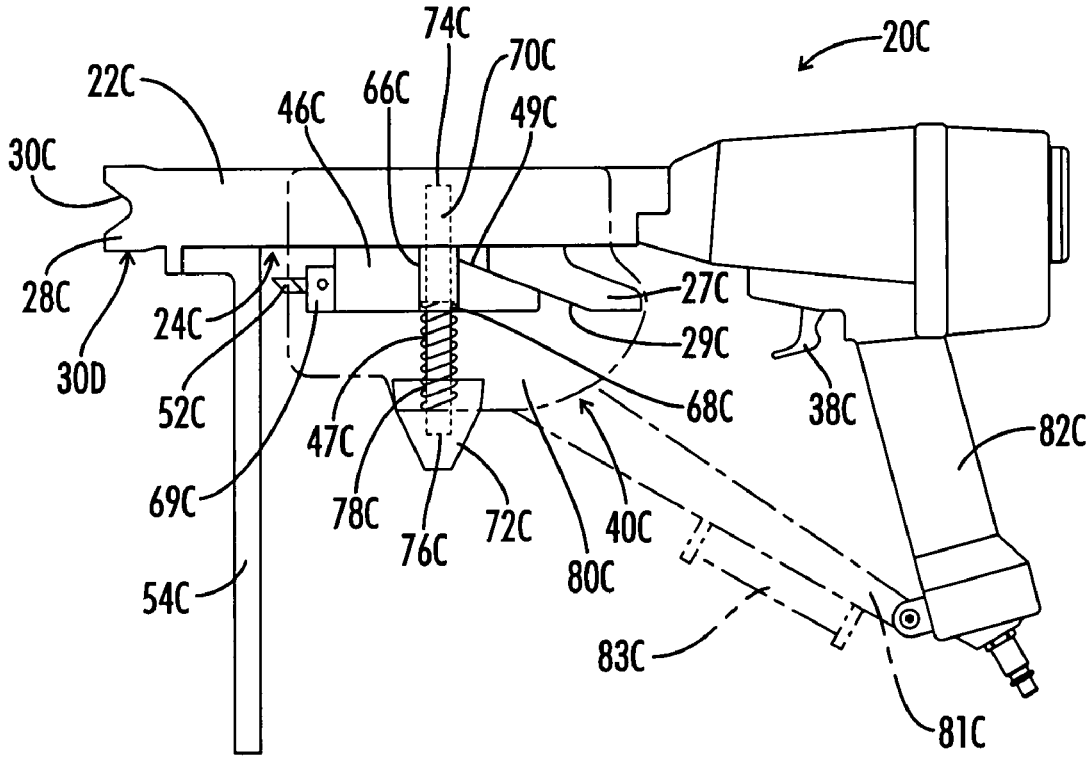
FIG. 17 is a side view of an embodiment of the bar connecting apparatus showing the clip feed assembly.

The clip track 54C is parallel to the guide shaft 70C, so the finger 52C will move parallel to the clip track 54C, as best seen in FIGS. 17, 18 and 19. The finger 52C is connected to the cam plate 46C, and the cam plate 46C moves parallel with the guide shaft 70C, so the finger 52C also moves parallel with the guide shaft 70C. The clip track 54C can be perpendicular to the barrel 22C, but it could also be at another angle, as long as it is parallel to the guide shaft 70C.

Method of Connecting Bars

The current invention also includes a method of connecting bars, which is shown in FIGS. 1, 5, and 10. The method includes providing a bar connecting apparatus 20 for applying clips 4 as described above. A clip string 2 is engaged with the clip track 54 of the bar connecting apparatus 20, and then slid along the clip track 54 until at least one clip 4 is received in the clip receiving cavity 24. The bar connecting apparatus 20 is then aligned with two transverse bars to be connected by an alignment head 28. The alignment head 28 has two pair of notches 30, so when the alignment head 28 is properly positioned each bar is engaged with one pair of the notches 30. The bar connecting apparatus 20 is actuated, which reciprocates a hammer 26 in the barrel 22. The hammer 26 contacts and expels the clip 4 received in the clip receiving cavity 24 such that the clip connects the bars. The cycling of the hammer 26 also cycles the clip feed assembly 40 to advance another clip 4 from the clip string 2 into the clip receiving cavity 24 for a subsequent clip application. The clip string 2 is advanced into the clip receiving cavity 24 in a direction transverse to the direction of reciprocation of the hammer.

The terminal clip 6C of the clip string 4C is inserted into the clip receiving cavity 24C of the bar connecting apparatus 20C, as seen in FIGS. 16 through 19. After the terminal clip 6C has been ejected to connect bars, the next clip 4C becomes the new terminal clip 6C, is advanced into the clip receiving cavity 24C by the clip feed assembly 40C, and the bar connecting apparatus is ready for a subsequent clip 4C application.

The alignment head 28C has two pair of notches 30C, 30D, wherein each pair of notches 30C, 30D has a different depth than the other pair, so the alignment head 28C will engage two transverse bars 9C, 11C to be connected with one bar 9C on top of the other 11C. Each bar 9C, 11C is engaged in one pair of notches 30C, 30D.

The method includes the providing of at least a first and second clip string 2C, wherein the size of the clips 4C in each clip string 2C is constant, but the clips 4C in the first clip string 2C are of a different size than the clips 04C of the second clip string 2C. The distance between the front ends of adjacent clips in the first and second clip string is the same. One clip string 2C is selected such that the clips 4C are sized properly for the bars to be connected. The selected clip string 2C is then inserted into the clip receiving cavity 24C for application of the clips 4C.

Thus, although there have been described particular embodiments of the present invention of a new and useful BAR CONNECTING APPARATUS, it is not intended that such references be construed as limitations upon the scope of this invention except as set forth in the following claims.

What is claimed is:

1. A clip string comprising:

a plurality of connected clips, wherein each clip has at least one adjacent clip, wherein each clip comprises a seat for positioning a first bar, a plurality of hooks for positioning a second bar, a joining portion wherein at least two hooks are joined by the joining portion, wherein each hook has an upper body located above the joining portion on an opposite side of the joining portion from the hooks, wherein the upper bodies of the hooks of each clip define a cradle for a bar; and at least one connection point defined on each clip, wherein each clip is connected to the adjacent clip at the connection point such that the clips are consistently oriented.

2. The clip string of claim 1 wherein the clip string has a length, and the cradles defined by the upper bodies are aligned perpendicular to the length of the clip string.

3. The clip string of claim 1 wherein the clip string has a length, and the cradles defined by the upper bodies are aligned parallel to the length of the clip string.

4. The clip string of claim 1 wherein the clips are comprised of plastic.

5. The clip string of claim 1 wherein the connection point further comprises a frangible tab with a length such that adjacent clips are separated by the tab length.

6. The clip string of claim 1 wherein each clip comprises four hooks, four upper bodies, and two joining portions, wherein each joining portion connects two hooks, and each upper body is connected to one other upper body.

7. The clip string of claim 1 wherein every clip is the same size.

8. The clip string of claim 5 wherein the tab includes an indent for providing a breaking point.

9. A clip string comprising:

a plurality of connected clips, wherein each clip comprises a seat for positioning of one bar, a plurality of hooks for the positioning of a second bar, a joining portion wherein at least two hooks are joined by the joining portion, wherein each hook has an upper body located above the joining portion on an opposite side of the joining portion from the hooks, wherein the upper bodies of the hooks of each clip define a cradle for a bar; and at least one connection point defined on each clip, wherein the plurality of clips are connected at the connection points such that the clips are all consistently oriented.

10. The clip string of claim 9 wherein the cradles defined by the upper bodies are aligned with each other.

11. The clip string of claim 9 wherein the clips are comprised of plastic.

12. The clip string of claim 9, wherein the cradles are each oriented perpendicular to a length of the clip string.

* * * * *